US010234198B2

(12) United States Patent
Wiedemeier

(10) Patent No.: US 10,234,198 B2
(45) Date of Patent: Mar. 19, 2019

(54) DEVICE AND PROCESS FOR ERADICATING PESTS IN WOOD

(71) Applicant: Thomas Robert Wiedemeier, Porterfield, WI (US)

(72) Inventor: Thomas Robert Wiedemeier, Porterfield, WI (US)

( * ) Notice: Subject to any disclaimer, the term of this patent is extended or adjusted under 35 U.S.C. 154(b) by 33 days.

(21) Appl. No.: 15/604,851

(22) Filed: May 25, 2017

(65) Prior Publication Data

US 2017/0261259 A1 Sep. 14, 2017

Related U.S. Application Data

(62) Division of application No. 12/876,211, filed on Sep. 6, 2010, now abandoned.

(51) Int. Cl.
*F27D 3/00* (2006.01)
*F26B 15/18* (2006.01)

(52) U.S. Cl.
CPC ..... *F26B 15/18* (2013.01); *F26B 2200/24* (2013.01); *F26B 2210/16* (2013.01)

(58) Field of Classification Search
USPC ..... 432/121
See application file for complete search history.

(56) References Cited

U.S. PATENT DOCUMENTS

| | | | | |
|---|---|---|---|---|
| 5,241,947 | A * | 9/1993 | Sandolo | A21B 1/24 126/21 A |
| 5,341,580 | A * | 8/1994 | Teal | F26B 17/045 34/164 |
| 6,678,994 | B2 * | 1/2004 | Topp | A01M 1/2094 43/124 |
| 7,038,172 | B1 * | 5/2006 | Stuck | A47J 37/044 219/388 |
| 2003/0042248 | A1 * | 3/2003 | Witt | A21B 1/42 219/497 |
| 2007/0284430 | A1 * | 12/2007 | Rock | H04Q 9/00 235/375 |

* cited by examiner

*Primary Examiner* — Nathaniel Herzfeld
(74) *Attorney, Agent, or Firm* — Steven H Greenfield; "Greenfield Invention and Patent Consulting, Inc."

(57) ABSTRACT

A device and process for heating wood for the purpose of eradicating burrowed pests such as gypsy moths and emerald ash borer beetles are disclosed. The device is used for treating firewood and pallets made of wood to insure that burrowed pests are killed before transporting the wood across state lines in following of state regulations. The device comprises a conveyor adapted for transporting firewood or pallets an insulated and heated chamber. The wood core temperature of the wood is monitored using wireless temperature sensors. Conveyor speed is adjusted according to temperature readings in order to achieve a threshold wood core temperature and in order to maintain the threshold wood core temperature for the minimum required period of time.

6 Claims, 5 Drawing Sheets

DEVICE AND PROCESS FOR ERADICATING PESTS IN WOOD

RELATED APPLICATIONS

This application is filed as a divisional application claiming priority from original patent application Ser. No. 12/876,211 filed on Sep. 6, 2010.

FIELD OF THE INVENTION

The present invention generally relates to a device and process for heating wood for the purpose of eradicating burrowed pests such as gypsy moths and emerald ash borer beetles. The device is used for treating firewood and pallets made of wood to insure that burrowed pests are killed before transporting the products across state lines or to other countries in compliance with state and federal regulations.

BACKGROUND OF THE INVENTION

Broadly, an embodiment of the present invention generally relates to a device and a continuous process for heating wood for the purpose of eradicating burrowed pests such as gypsy moths and emerald ash borer beetles. Firewood as well as wood pallets and skids used for transporting other goods are particularly susceptible to gypsy moths and emerald ash borer beetle infestation since they are not heat treated in the course of the manufacturing so as to cause the extermination of these pests. Some state laws prohibit transporting infested wood across state lines and out of quarantined areas.

The eradication of gypsy moths and emerald ash borer beetle infestation in wood is currently carried out in wood kilns where the temperature in the center of the wood is raised to at least 160° F. and held there for at least 75 minutes. Heating may be supplied by electricity, hot water, steam and fire. A certification process by the Center of Plant Health and Science Technology requires obtaining internal wood temperature sensors placed in several representative locations that are accurate within +/−0.5° F. The use of a wood drying kiln to eradicate gypsy moths and emerald ash borer beetles in fire wood and pallets is slow and expensive. Other processes approved by state laws such as fumigation and debarking are equally problematic. Fumigation involves the use of chemicals that are toxic to the environment and to humans. While debarking is effective, a large amount of non-bark material is lost from the firewood in the process. Heat treatment is effective because it kills bugs and mold and also dries the firewood, resulting in lighter loads.

Prior art relevant to this invention includes U.S. Pat. No. 5,341,580 that discloses a process for drying wood strands for the manufacture of oriented strand board comprising the steps of: feeding wood strands onto a belt conveyor to form a bed of strands; conveying the wood strands on the belt conveyor through a dryer housing in a substantially continuous manner; heating a quantity of drying air to a desired temperature; passing the drying air through the bed of strands in the dryer housing; and after passing the drying air through the bed of strands, discharging the wood strands from the dryer housing. U.S. Pat. No. 6,163,981 discloses a process and apparatus for drying material, especially wood particles, having moisture therein, and comprising depositing the material to a selected depth onto a transport conveyor at the first end of a drying chamber. Heat is applied to the material as it is transported toward the opposite second end of the drying chamber so that, adjacent the second end, the material forms essentially two layers, a first layer having a first level of moisture therein and a second layer having a second level of moisture therein which is different from the moisture content of the first layer. Means are provided adjacent the second end for removing the second layer, which has the desired moisture, from the conveyor and directing that layer exteriorly of the chamber. U.S. Pat. No. 6,678,994 relates to a process of eradicating pests by the controlled application of heat for a predetermined period of time. U.S. Pre-grant publications No. 20060272172 and 200700443431 teach a dual path kiln having one or more chambers and at least two lumber charge paths adapted to convey lumber through the kiln in opposite directions. U.S. Pre-grant publication No. 200700443431 is a continuation of U.S. Pre-grant publication No. 20060272172. U.S. Pre-grant publications No. 20080127548 refers to a process for killing insect pests in wood, comprising the steps of: a) disposing wood in a vacuum-tight container having a flexible wall; b) evacuating the container such that the flexible wall presses against the wood; and c) performing step (b) until the insect pests in the wood are killed.

SUMMARY OF THE PRESENT INVENTION

In one aspect of the present invention, a system for heating the interior of wood pieces to a threshold temperature and holding the temperature constant for a threshold time period comprises: a substantially closed chamber comprising a first sidewall, a second sidewall, a floor, a ceiling, an entrance port and an exit port defining a chamber interior; a door adapted for opening and closing around the entrance port and a door adapted for opening and closing around the exit port; a conveyor adapted for conveying the wood pieces from the entrance port through the chamber interior and out the exit port; a heating system configured for heating the chamber interior; an air circulating system adapted for circulating air inside the chamber interior; a drive adapted for moving the conveyor from a location prior to the entrance port to a location past the exit port at varying speed levels; a plurality of sensors adapted for embedding in the interior of the wood pieces, the sensors also being adapted for sensing the temperature in the interior of the wood pieces and adapted for transmitting signals proportional to the temperature in the interior of the wood pieces; and a data processing station adapted for receiving and processing the signals and for providing readouts of the temperatures from the signals.

In another aspect of the present invention, a continuous process for heating the interior of wood pieces to a threshold temperature and holding the temperature constant for a threshold time period using a system comprising a substantially closed chamber comprising a first sidewall, a second sidewall, a floor, a ceiling, an entrance port and an exit port defining a chamber interior, a door adapted for opening and closing around the entrance port and a door adapted for opening and closing around the exit port, a conveyor adapted for conveying the wood pieces from the entrance port through the chamber interior and out the exit port, a heating system configured for heating the chamber interior, an air circulating system adapted for circulating air inside the chamber interior, a drive adapted for moving the conveyor from a location prior to the entrance port to a location past the exit port at varying speed levels, a plurality of sensors adapted for placement in the interior of the wood pieces, the sensors also being adapted for sensing the temperature in the interior of the wood pieces and adapted for transmitting signals proportional to the temperature in the interior of the wood pieces; and a data processing station adapted for receiving and processing the signals and for providing readouts of the temperatures from the signals, the process comprises: preheating the interior of the chamber to the threshold temperature; providing wood pieces for heat treatment; embedding temperature sensors into a preselected sampling of the wood pieces, the sensors being adapted for transmitting a wireless signal proportional to temperature; placing the wood pieces on the conveyor; conveying the wood from the entrance of the chamber, through the interior and to the exit of the chamber at a preset conveyor speed; receiving the signals transmitted by the temperature sensors and obtaining temperature readouts from the signals; monitoring the readouts; collecting the wood pieces exiting through the exit port; removing the temperature sensors from any processed wood pieces containing temperature sensors; and transporting the wood pieces for further processing and shipping.

These and other features, aspects and advantages of the present invention will become better understood with reference to the following drawings, description and claims.

DETAILED DESCRIPTION OF THE INVENTION

Figure 1:
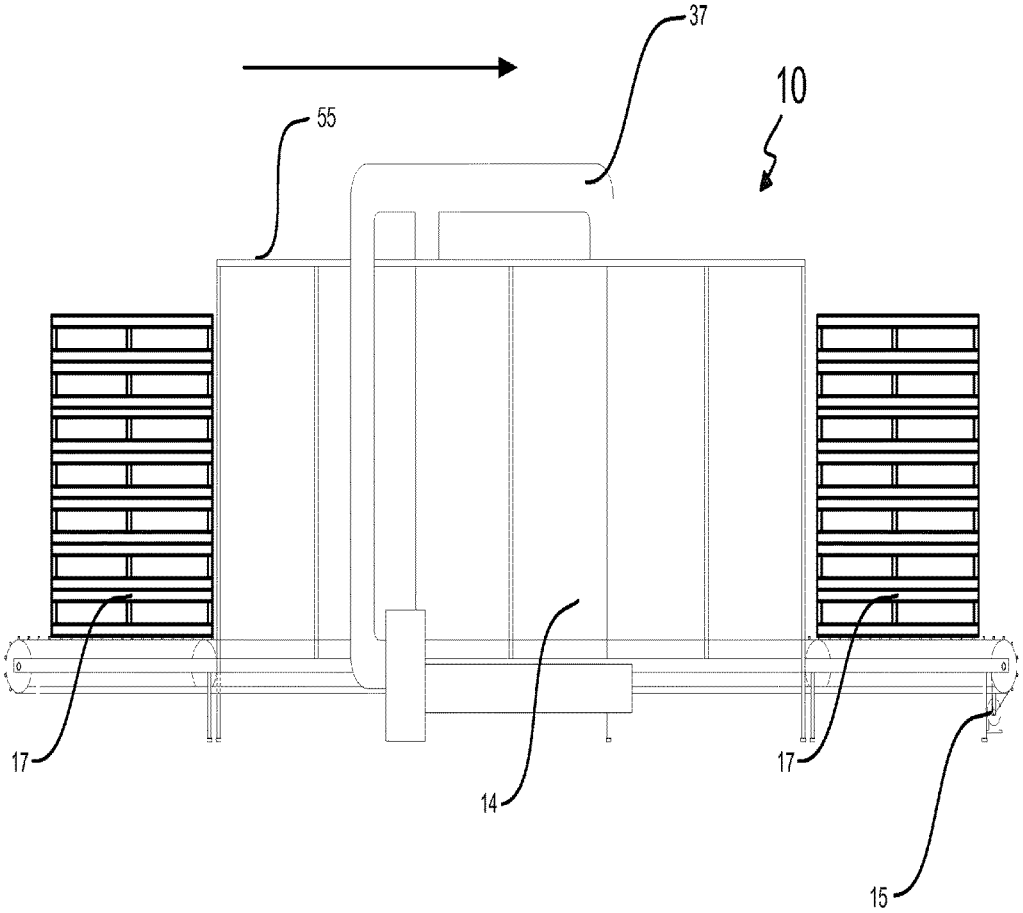
FIG. 1 is a side view of the device in the process of heating pallets according to an embodiment of the present invention.

The following detailed description is of the best currently contemplated modes of carrying out exemplary embodiments of the invention. The description is not to be taken in a limiting sense, but is made merely for the purpose of illustrating the general principles of the invention.

The present invention relates to a wood heating device comprising an insulated chamber and a conveyer used for transporting wood logs and pallets through the chamber for heat treatment. The purpose of heat treating pallets and wood logs is to eradicate pests such as gypsy moths and emerald ash borer beetles that may have burrowed inside the wood. Regulations of several states require treating firewood logs and pallets at preset core temperatures for preset periods of time. Pallets may include various types of wooden platforms used for placement of goods to be transported by truck or rail and typically movable using a fork lift vehicle. Current regulations require fire wood to be heated in a way that the interior wood reaches a threshold temperature of at least 160 degrees F. and held at that temperature for a threshold time period of at least 75 minutes, and that dimensions of the wood logs not exceed 4 inches in width, 4 inches in height and 16 inches in length. The regulations require wood pallets to be heated in a way that the interior of the wood reaches a threshold temperature of at least 132 degrees F. and held at that temperature for a threshold time period of at least 30 minutes.

The chamber has a substantially rectangular cuboid shape having a length, a width and a height and is characterized by a first sidewall, a second sidewall, a ceiling, a floor, an entrance port and an exit port. A conveyor traverses through the length of the chamber from a location in front of the entrance port and a location past the exit port. The chamber and conveyor must be sufficiently wide to accommodate both wood log bundles and stacks of pallets placed on it. Alternatively, separate devices for firewood logs and pallets may be used. In an embodiment of the present invention, the interior of the chamber contains two stacks of heating coils positioned at the sides of the chamber near the sidewalls but preferably at a distance of least about 0.5 inches from the side walls into the interior. Each stack may contain between about 10-15 coils; each coil having a capacity of between about 800-2600 watts. The heating system is configured for operating at its maximum rated capacity and to maintain a chamber interior temperature of about 500 degrees F. in the preheating stage. In the process of heat treating the wood, the interior chamber temperature typically falls to about 350 degrees F. as the wood absorbs a substantial amount of heat energy generated by the process. It will be appreciated by those skilled in the art that in order to reach the threshold interior wood temperatures and to maintain the threshold temperature for the required threshold time period, the speed of the conveyor needs be adjusted according to actual wood interior temperature levels. Wireless data loggers, known in the current art for performing remote temperature measurements, may be used to obtain temperature data of the wood interior. Wireless data loggers are configured to sense temperature and transmit a signal proportional to that temperature to a receiving station that converts the signal to a computer input which then can be read by the operator of the device. State regulations specify that in the process of heating the wood, at least three data loggers must be present at all times that read temperatures with and accuracy of 't.0.5 degrees F. Therefore, in a typical protocol, wireless sensors would be placed in wood pieces that are spread apart on the conveyor in such a way that when a wood piece containing wireless sensors exits the chamber, a wood piece containing a wireless sensor enters the chamber at the entrance side. A frequency drive capable of moving the conveyor at relatively low speeds while maintaining the speed of the conveyor relatively constant is preferably used. To allow the interiors of the wood pieces to reach the threshold temperature and to hold them at that temperature for the threshold time period, a combination of sufficient chamber length, conveyor speed and chamber interior temperature must be provided. The chamber length may range from 15.0 to 100.0 feet and conveyor speed may range from about 0.15 feet per minute to about 1.0 feet per minute. This provides at least 100 minutes of residence time in the chamber to ramp up the temperature in the wood interior to the threshold level and maintain it for the threshold time period. In an embodiment of the present invention, the chamber length is about 20.0 feet; thus a conveyor speed of 0.2 feet per minutes provides a total dwell time in the chamber of 100 minutes. The width and height of the chamber interior need to be able to accommodate firewood logs to pallets sizes. The width of the wood heating device chamber interior may range from about 2 feet to about six feet and the height may range from about 2.5 feet to about 10 feet. The entrance and exit ports are equipped with swing doors configured to be in a closed position during the preheating stage and in an open position when the stacks of firewood or pallets pass through and exit the chamber. The doors open just enough to allow the wood to enter and exit but keeps outside air interference to a minimum. Additional measures to reduce heat losses in the system may include insulation added to the chamber walls and an air curtain device configured to apply a current of air using a downward-facing blower fan mounted over the entrance to the chamber and a downward-facing blower fan mounted over the exit from the chamber. This current helps keep any outside cold air drafts out of the chamber and preventing hot air from escaping the chamber. A separate air circulation blower circulates air inside the chamber.

In an embodiment of the present invention, the process of operating the device starts with preheating the oven at maximum heating capacity typically reaching about 500 degrees F. The wood logs, typically tied into bundles, or wood pallets are then lined up in the order of placement on the conveyor and wireless sensors are embedded into preselected wood pieces such that at least three sensors are inside the chamber at all times during the heat treatment process. The operator of the device collects temperature data transmitted by the sensors and adjusts the speed of the conveyor according to the readings. If the measured temperature is lower than the threshold temperature, conveyor speed may be reduced or stopped altogether until the temperature readings reach threshold levels. Conversely, the conveyor speed may be increased if the measured temperature is higher than the threshold temperature. Finally, the processed firewood logs or pallets exiting through the exit port are collected, the temperature sensors from any processed wood pieces containing temperature sensors are removed for reuse and the processed logs or pallets are packaged and shipped.

Figure 2:
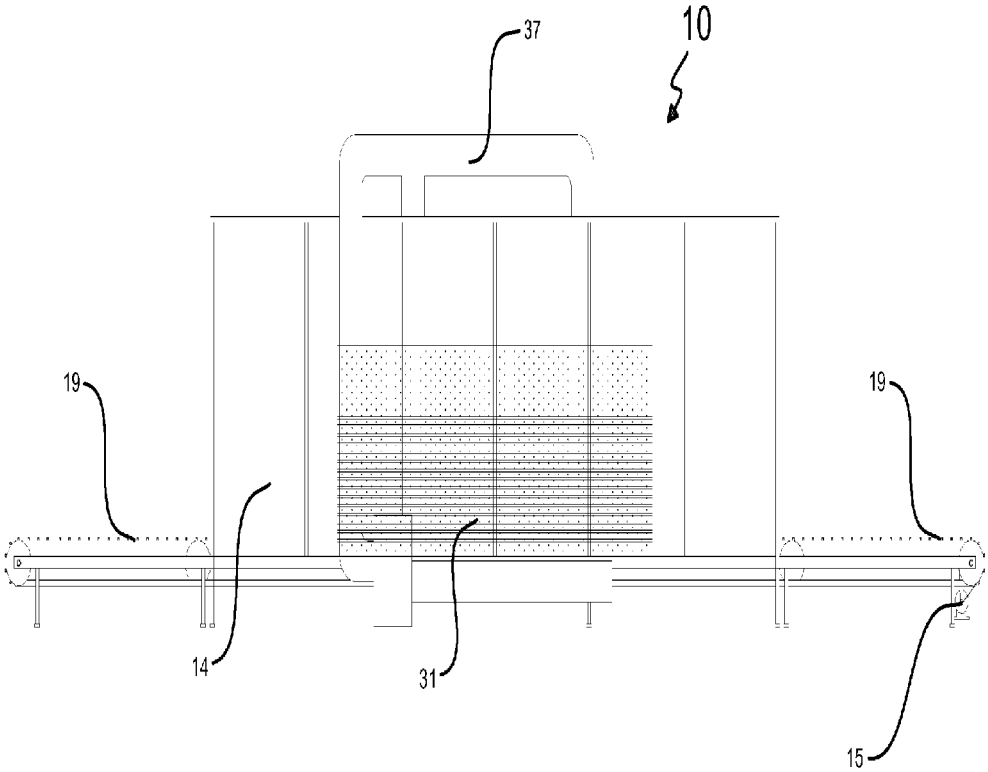
FIG. 2 is a cross sectional view of the device according to an embodiment of the present invention.
Figure 3:
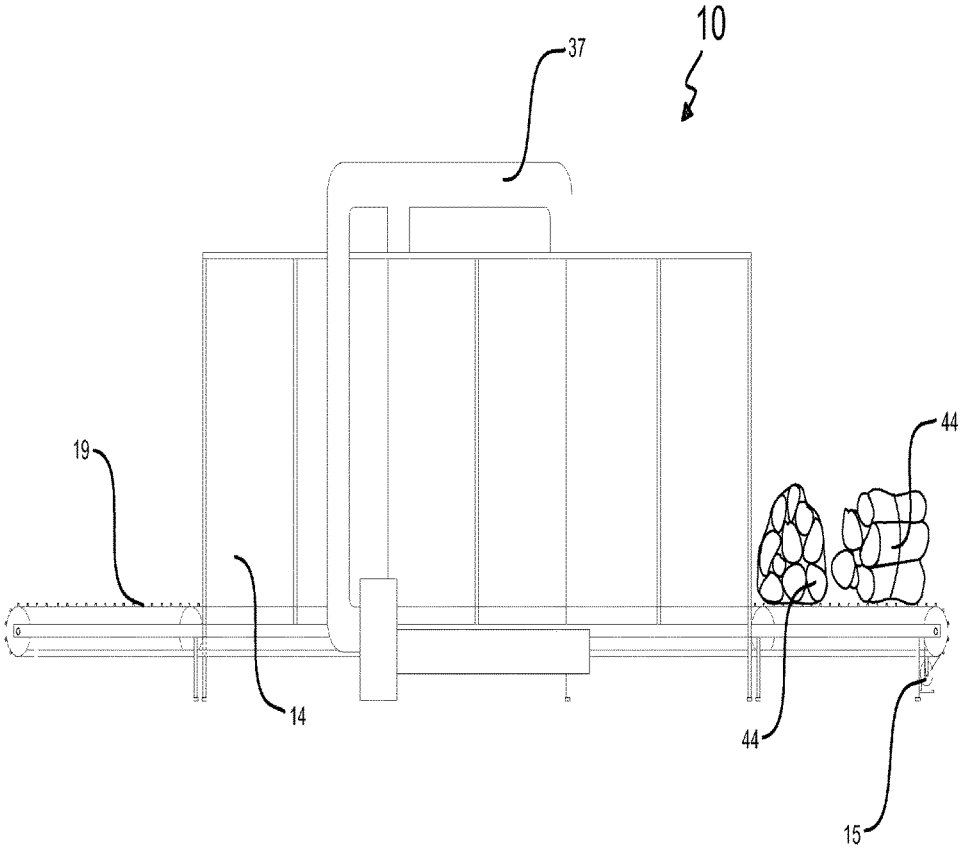
FIG. 3 is a side view of the device in the process of heating bundled fire wood logs according to an embodiment of the present invention.
Figure 4:
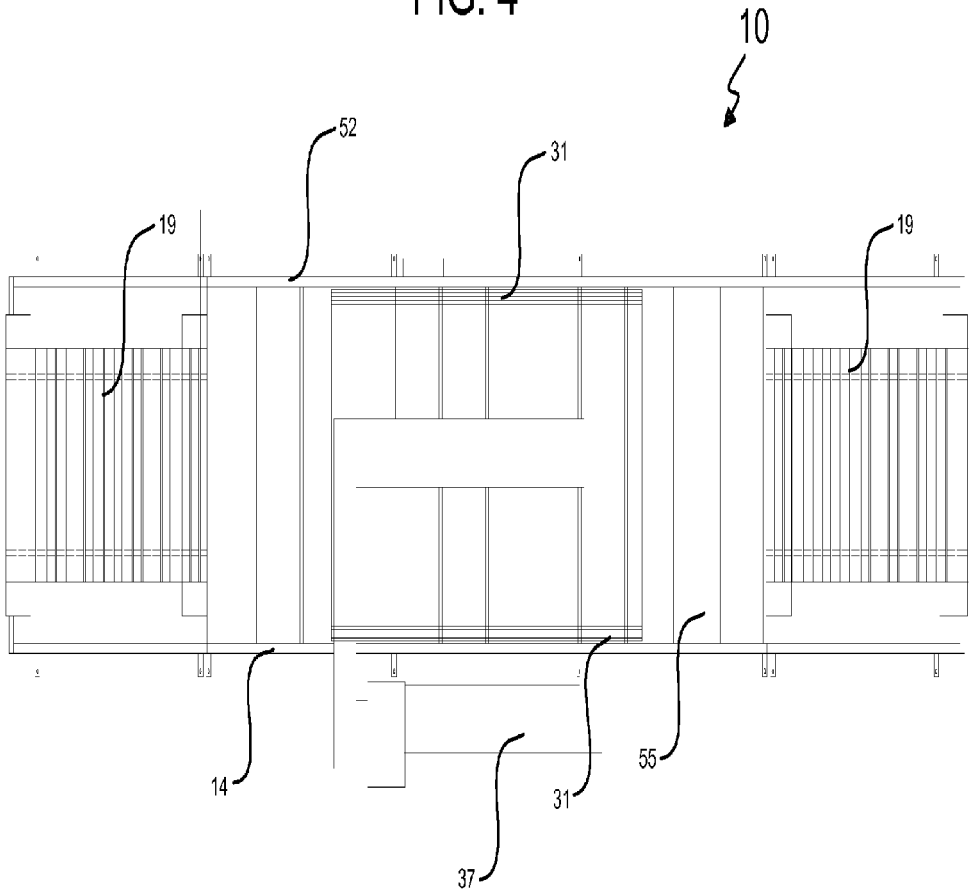
FIG. 4 is a top view of the device according to an embodiment of the present invention.
Figure 5:
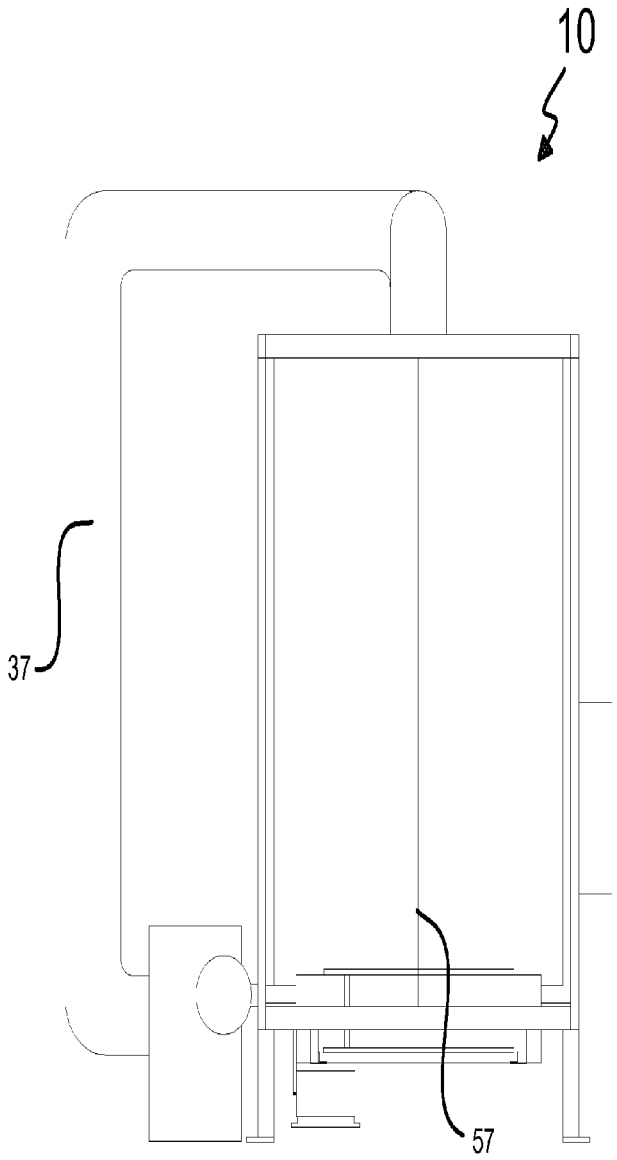
FIG. 5 is a front view of the device according to an embodiment of the present invention.

FIGS. 1-5 illustrate an embodiment of the present invention. Shown is the device 10 having a conveyor 19 that traverses the heating chamber comprising a first sidewall 14, a second sidewall 52, a ceiling 55 and swing doors 57 disposed at the exit side of the chamber. An air blower 37 circulates the air in the interior of the chamber. Frequency drive 15 is configured to move the conveyor at low but steady speeds.

Heating coil stack 31 is disposed vertically in the interior of the chamber at a distance from the first side wall 14. Pallet stacks 17 or firewood log bundles 44 are placed on the conveyor 19 to be transported into the chamber for the heat treatment then through the chamber exit.

In an embodiment of the present invention, the temperature measurements are conducted using U12 stainless temperature data loggers made by the HOBO Company. The chamber sidewalls, ceiling, floor, entrance doors and exit doors may be insulated using Spinglass 1000PL fiber insulation manufactured by Allied Insulation or Fibrex Insulated Board colloidal silica high temperature fiberboard manufactured by Fibrex Insulating Products. The frequency drive control is a Square D ATV31H075N4. The air curtains are VSA048 Unheated Air Curtain manufactured by Berner International Corporation that are installed about 18 inches above the entrance and exit doors.

It should be understood, of course, that the foregoing relates to exemplary embodiments of the invention and that modifications may be made without departing from the spirit and scope of the invention.

I claim:

1. A continuous process for heating the interior of wood pieces to a threshold temperature and holding the temperature constant for a threshold time period using a system comprising a substantially closed chamber comprising a first sidewall, a second sidewall, a floor, a ceiling, an entrance port and an exit port defining a chamber interior, a door adapted for opening and closing around the entrance port and a door adapted for opening and closing around the exit port, a conveyor adapted for conveying the wood pieces from the entrance port through the chamber interior and out the exit port, a heating system configured for heating the chamber interior, an air circulating system adapted for circulating air inside the chamber interior, a drive adapted for moving the conveyor from a location prior to the entrance port to a location past the exit port at varying speed levels, a plurality of sensors adapted for placement in the interior of the wood pieces, said sensors also being adapted for sensing the temperature in the interior of the wood pieces and adapted for transmitting signals proportional to the temperature in the interior of the wood pieces; and a data processing station adapted for receiving and processing said signals and for providing readouts of the temperatures from said signals, said process comprising:

preheating the interior of the chamber to a predetermined temperature;

providing wood pieces for heat treatment;

embedding temperature sensors into a preselected sampling of the wood pieces, said sensors being adapted for transmitting a wireless signal proportional to temperature;

placing the wood pieces on the conveyor;

conveying the wood from the entrance of the chamber, through the interior and to the exit of the chamber at a preset conveyor speed, said conveying passing through an entrance port swing door partially open only to an extent as to allow the conveyor to pass through, the conveying also passing through an exit port swing door partially open only to an extent as to allow the conveyor to move through, said conveying speed ranging from 0.15 ft/min to about 1 ft/min to achieve at least 100 minutes of residence time at an interior threshold wood temperature of at least 160 degrees F.;

generating a downwardly directed air current parallel with the entrance port of the chamber and generating a downwardly directed current parallel with the exit port of the chamber;

receiving the signals transmitted by the temperature sensors and obtaining temperature readouts from said signals;

monitoring said readouts;

collecting the wood pieces exiting through the exit port;

removing the temperature sensors from any processed wood pieces containing temperature sensors; and transporting said wood pieces for further processing and shipping.

2. The process of claim 1 further comprising:

if temperature readings transmitted by the sensors are below the threshold wood interior temperature, reducing conveyor speed as needed to increase temperature readings.

3. The process of claim 1 further comprising:

if temperature readings transmitted by the sensors are above the threshold wood interior temperature, increasing conveyor speed as needed for the wood interior temperature to decrease to threshold level.

4. The process of claim 1 further comprising:

if temperature readings transmitted by the sensors are below the threshold wood interior temperature, turning off the conveyor and holding the wood pieces motionless until the temperature readings increase to the threshold level.

5. The process of claim 1, further comprising embedding at least three temperature sensors in wood pieces in a manner that said three sensors are present in the interior of the chamber during heat treatment.

6. The process of claim 1, wherein the temperature sensors comprise wireless data loggers.

* * * * *